United States Patent [19]

Langheinrich et al.

[11] 4,106,903

[45] Aug. 15, 1978

[54] PROCESS FOR THE TREATMENT OF CELLULOSE-FIBRES

[75] Inventors: Klaus Langheinrich, Schildgen; Otto Berenstecher, Bensberg-Refrath; Horst Renziehausen, Monheim, all of Fed. Rep. of Germany

[73] Assignee: Bayer Aktiengesellschaft, Leverkusen, Fed. Rep. of Germany

[21] Appl. No.: 698,958

[22] Filed: Jun. 23, 1976

[30] Foreign Application Priority Data

Jun. 24, 1975 [DE] Fed. Rep. of Germany ..... 2527962

[51] Int. Cl.[2] ..... D06M 13/46

[52] U.S. Cl. ..... 8/196; 8/115.6; 8/115.7; 8/188

[58] Field of Search ..... 8/188, 196, 115.6, 115.7

[56] References Cited

U.S. PATENT DOCUMENTS

| | | | |
|---|---|---|---|
| 2,868,748 | 1/1959 | Frazier | 8/115.6 |
| 3,510,246 | 5/1970 | Keen | 8/188 |
| 3,754,859 | 8/1973 | Doerr | 8/115.6 |
| 3,853,460 | 12/1974 | Balland | 8/188 |
| 3,993,640 | 11/1976 | Pickard | 8/115.6 |

*Primary Examiner*—Paul R. Michl

*Attorney, Agent, or Firm*—Plumley and Tyner

[57] ABSTRACT

Process for the treatment of cellulose fibres in the form of a doubled pre-drawn sliver, by impregnating with fixing agents of the formula

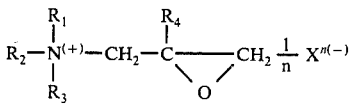

in which:

$R_1$, $R_2$ and $R_3$ represent $C_1$-$C_4$-alkyl, or hydroxyl-substituted $C_2$-$C_4$-alkyl or $R_1$ and $R_2$ can be jointed to form a ring with N, $R_4$ represents hydrogen or methyl, $X^{n(-)}$ represents an anion and $n$ represents 1, 2 or 3, and with adhesives, and subsequently subjecting to a fixing process.

5 Claims, No Drawings

PROCESS FOR THE TREATMENT OF CELLULOSE-FIBRES

The subject of the invention is a process for the treatment of cellulose fibres with fixing agents before the manufacture of yarn. The process is characterised in that cellulose fibres or their mixtures with synthetic fibres, in the form of a doubled pre-drawn sliver, are impregnated with fixing agents of the general formula

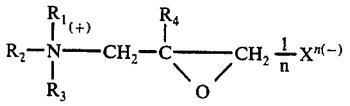

(I)

in which $R_1$, $R_2$ and $R_3$ represent a $C_1$-$C_4$-alkyl group, or a hydroxyl-substituted $C_2$-$C_4$-alkyl group or $R_1$ and $R_2$ can be joined to form a ring with N, $R_4$ represents hydrogen or a methyl group, $X^{n(-)}$ represents an anion and

*n* represents 1, 2 or 3, and with adhesives, and are subsequently subjected to a fixing process.

In this process it is possible either simultaneously to apply anionic dyestuffs, preferably of the type of the direct dyestuffs, or to carry out the process subsequent to the impregnation and fixing and, if desired, after the cellulose has been further processed to give yarns, woven fabrics, knitted fabrics and non-wovens.

Possible anions $X^{n(-)}$ are both anions of inorganic acids, for example, the chloride, bromide, sulphate or phosphate ion, and anions of organic acids, for example of aromatic or lower aliphatic sulphonic acids, such as the benzenesulphonate, p-toluenesulphonate, methanesulphonate or ethanesulphonate ion, and also the anions of acid alkyl esters of inorganic acids, such as the methosulphate and the ethosulphate ion.

$R_1$ and $R_2$ together with N preferably form a 5-membered or 6-membered ring, for example a pyrrolidine, piperidine, morpholine or thiamorpholine ring.

As examples of representatives of the compounds of the formula (I) there may be mentioned: N-trimethyl-N-(2,3-epoxypropyl)-ammonium chloride, N-triethyl-N-(2,3-epoxypropyl)-ammonium chloride, N-tributyl-N-(2,3-epoxypropyl)-ammonium chloride, N-propyl-N-dimethyl-N-(2,3-epoxypropyl)-ammonium chloride, N-trimethyl-N-(2,3-epoxy-2-methyl-propyl)-ammonium methosulphate, N-methyl-N-(2,3-epoxypropyl)-morpholinium chloride, N-ethyl-N-(2,3-epoxy-2-methyl-propyl)-thiamorpholinium chloride, N-butyl-N-(2,3-epoxypropyl)-piperidinium bromide, N-methyl-N-(2,3-epoxypropyl)-pyrrolidinium chloride, N-methyl-n-(2,3-epoxypropyl)-morpholinium p-toluenesulphonate, N-2-hydroxyethyl-N-(2,3-epoxypropyl)-morpholinium chloride, N-methyl-N-(2,3-epoxypropyl)-morpholinium methosulphate and N-ethyl-N-(2,3-epoxy-2-methyl-propyl)-morpholinium ethosulphate.

The preparation of the compounds of the formula (I) can be carried out in accordance with various processes which are in themselves known (see, for example, Houben-Weyl, "Methoden der Organischen Chemie" ("Methods of Organic Chemistry"), volume XI/2, page 611, 4th edition 1968; French Patent Specification 1,450,083, DOS (German Published Specification) 2,056,002 and U.S. Pat. No. 3,737,406.)

They are preferably prepared by quaternising amines of the formula

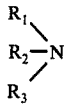

(II)

in which:

$R_1$ to $R_3$ have the meaning indicated under formula (I), with epoxy compounds of the formula

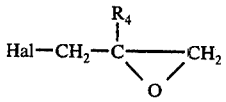

(III)

in which:

$R_4$ has the meaning indicated under formula (I) and

Hal represents a halogen atom, preferably a chlorine or bromine atom.

Possible adhesives are those water-soluble compounds, free from hydroxyl groups, which are also known as sizes in textile chemistry. Preferentially usable adhesives are alginates, especially sodium alginate or ammonium alginate, polyacrylates or polymethacrylates and their copolymers, and polyvinyl acetates, which are described, for example, in K. Lindner "Tenside - Textilhilfsmittel - Waschrohstoffe" ("Surface-active agents - Textile assistants - Detergent raw materials"), volume II (1964), pages 1726 and 1727.

The cellulose fibre materials are both materials of natural cellulose, such as cotton and linen, or regenerated cellulose, such as rayon. Synthetic fibre materials which can be admixed to the cellulose are polyester, polyamide, polyacrylonitrile, modified acrylic or acetate fibres.

Examples of direct dyestuffs are described in the Colour Index, 3rd edition (1971), volume 2, pages 2005 to 2478.

The cellulose materials treated with the fixing agents of the formula (I) and adhesives can, after processing to yarns or textile sheet-like structures, be dyed from a dilute or concentrated liquor.

Both the pretreatment and the simultaneous treatment with the direct dyestuffs are carried out by impregnating the cellulose fibre materials with aqueous liquors which contain the compounds of the formula (I), advantageously in an amount of 10 to 100 g, preferably 20 to 60 g, and the adhesives, advantageously in an amount of 5 to 50 g, preferably 10 to 20 g, per liter of padding liquor, the alkali required for the fixing onto the fibres, for example sodium carbonate, sodium bicarbonate or, preferably, sodium hydroxide, and, where relevant, the direct dyestuff, as well as, where necessary, a solubilising, or solubilising and dispersing, product, for example based on a carboxylic acid amide, and subjecting the fibre materials to a fixing process after squeezing off to a certain liquor pick-up, for example 50%.

The impregnation is carried out at 20° to 80° C, but preferably at 25° to 30° C.

The fixing process can be effected by steaming for 1 to 10 minutes at 100° to 150° C, preferably by steaming for 8 minutes at 103° C, or by steaming for 1 to 5 minutes at 130° to 170° C, or by a dry treatment of 1 to 5 minutes at 100° to 220° C, preferably a dry treatment for 3 minutes at 150° C.

The fixing can also be carried out in accordance with the cold pad batch process, by storing the padded material for 8 to 48 hours, preferably 12 - 24 hours, at room temperature.

The impregnation, fixing and further processing of the sliver are preferably carried out in the manner described in Swiss Patent Specification 428,514 and in "Textile Month," January 1973, page 30 et seq.

In these publications, a doubled, pre-drawn sliver of cellulose fibres or their mixtures with synthetic fibres is treated with adhesives in a special impregnating apparatus and after a subsequent drying, thermofixing or steaming process a fixed sliver is obtained. This fixed sliver can be fed directly to the ring spinning machine, circumventing the flyer, or gives, after a further pass through a second unit, a processable yarn.

However, hitherto satisfactory fixing, and hence adequate fastness properties of the direct dyestuffs on the cellulose fibre, were not achievable by means of these processes.

With the aid of the new process it has now proved possible to achieve excellent fixing. It has been possible substantially to improve the fastness properties, especially the wet fastness properties of the dyeings achieved.

In addition, a substantial increase in depth of colour was achievable at the same time.

Because of the excellent fixing action it is also possible to dispense with the soaping, at the boil, of the dyed cellulose materials, which is customary in this process in order to achieve good fastness properties. Very good fastness properties are achieved merely by simple hot rinsing.

In the case of mixtures of synthetic fibres with cellulose fibres, such as, for example, polyester/cellulose, it is possible also to add a disperse dyestuff, for dyeing the polyester fibre component, to the impregnated liquors alongside the direct dyestuff for the cellulose fibre constituent.

The five-figure Colour Index numbers given in the examples which follow relate to the data in the Colour Index, 3rd edition (1971), volume 4; the other dyestuffs used are described in the Colour Index, 3rd edition (1971), volume 2.

EXAMPLE 1

A doubled, pre-drawn cotton sliver is impregnated, in an impregnating apparatus such as that described in Swiss Patent Specification 428,514, with a liquor which contains the following compounds: 60 g/l of N-methyl-N-(2,3-epoxypropyl)morpholinium chloride, 20 g/l of the dyestuff of the formula

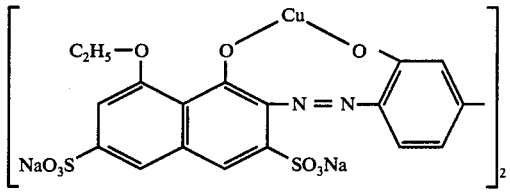

10 ml/l of sodium hydroxide solution of 38° Bé strength, 2g/l of di-(2-ethyl-hexyl) monosodium phosphate, 2g/l of ethylene glycol and 15 g/l of Na alginate (neutral alginate thickener). The temperature of the treatment is 25° C. After impregnation, the material is squeezed off to a liquor pick-up of 50% and is subjected to a dry heat treatment for 3 minutes at 150° C.

After the manufacture of a yarn or thread, or woven fabric, knitted fabric or other textile sheet-like structure, the material is rinsed in cold and hot water and soaped at the boil for a few minutes.

A brilliant and fast blue dyeing having the following excellent wet fastness properties results.

| | | |
|---|---|---|
| DIN 54,006 | Fastness to water, severe conditions | 5<br>5 |
| DIN 54,020 | Fastness to perspiration, alkaline | 5<br>5 |
| DIN 54,020 | Fastness to perspiration, acid | 5<br>5 |
| DIN 54,010 | Washing at 60° C | 5<br>5 |
| DIN 54,011 | Washing at 95° C | 4–5<br>5 |

The upper figure denotes the staining of cotton and the lower figure the staining of rayon or wool.

Equally good results were achievable when using the dyestuffs C.I. 35,860 and 23,160 or dyestuffs of the formulae

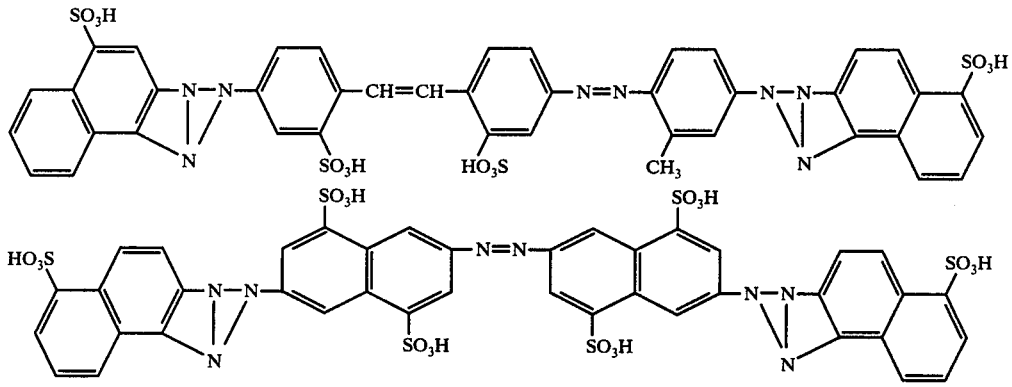

-continued

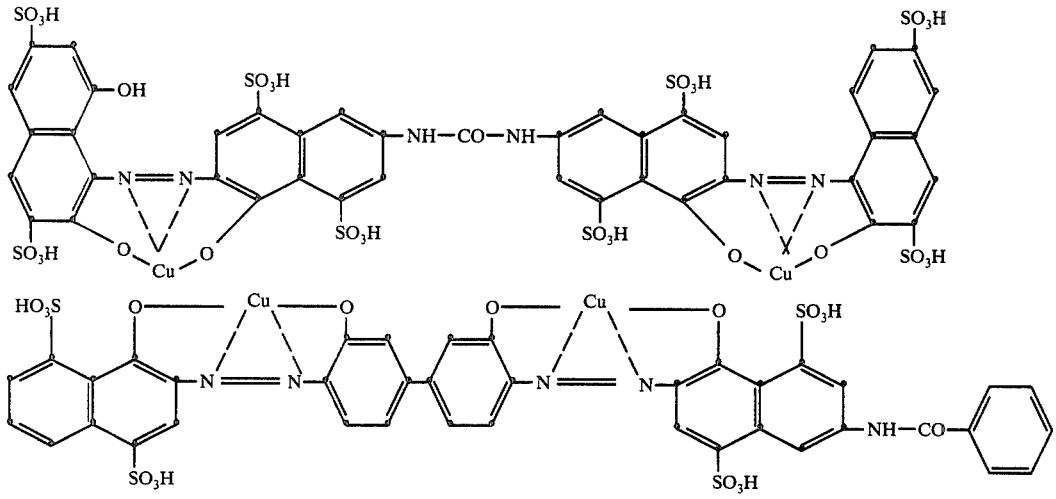

The N-methyl-N-(2,3-epoxypropyl)morpholinium chloride used is prepared as follows:

8.325 g (90 mols) of epichlorohydrin are heated to 50° C in a 10 l three-necked flask equipped with an internal thermometer, stirrer, dropping funnel, condenser and drying tube, and thereafter 1,822 g (18 mols) of N-methylmorpholine are added continuously over the course of 1 hour at this temperature, with intensive stirring and exclusion of atmospheric moisture. The reaction mixture is now stirred intensively for a further 24 hours under the same conditions, in the course of which the reaction product starts to crystallise out already about 1 hour after completion of the addition of the N-methylmorpholine. After the mixture has cooled to room temperature and stood overnight, the reaction product is filtered off, thoroughly washed repeatedly with ethyl acetate and finally dried at 50° C (ultimately under 13 mm Hg) in a vacuum drying cabinet.

Yield: 3,310 g of N-methyl-N-(2,3-epoxypropyl)morpholinium chloride (95% of theory); grey-white hygroscopic salt; melting point 160° to 161° C (with decomposition); $C_8H_{16}ClNO_2$ (molecular weight 193.5), calculated: 18.33% Cl; found: 18.20% Cl.

EXAMPLE 2

A doubled pre-drawn cotton sliver is impregnated, in an impregnating apparatus such as that described in Swiss Patent Specification 428,514, with a liquor which contains the following compounds: 60 g/l of N-trimethyl-N-(2,3-epoxypropyl)-ammonium chloride, 10 ml/l of sodium hydroxide solution of 38° Bé strength, 1.5 g/l of di-(2-ethyl-hexyl) monosodium phosphate, 1.5 g/l of ethylene glycol and 10 g/l of Na alginate (neutral alginate thickener). The temperature of the treatment bath is 25° C. After impregnation, the material is squeezed off to a liquor pick-up of 40% and subjected to a thermofixing process for 3 minutes at 150° C.

EXAMPLE 3

A doubled, pre-drawn sliver of polyester and cotton mixed in the ratio of 67:33 is impregnated in an impregnating apparatus corresponding to Example 1, with a liquor which contains the following compounds: 40 g/l of N-methyl-N-(2,3-epoxy-propyl)-morpholinium chloride, 10g/l of the dyestuff of example 1, 12 g/l of the disperse dyestuff of the formula

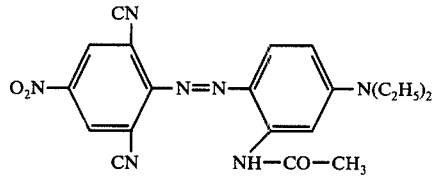

2 g/l of di-(2-ethyl-hexyl) monosodium phosphate, 2 g/l of ethylene glycol, 3 g/l of the sodium salt of trichloroacetic acid, 12 g/l of Na alginate and 100 g/l of urea or another carboxylic acid amide.

The temperature of the treatment bath is 25° C. After impregnation, the material is squeezed off to a liquor pick-up of 50% and subjected to a dry treatment for 1 minute at 200° C.

After a yarn or a textile sheet-like structure has been produced, the material is rinsed cold and warm and soaped for 5 minutes at the boil.

The dyeing is distinguished by excellent wet fastness properties.

Equally good results are obtained if, instead of the alginate thickener, another thickener, for example based on polyacrylates, is used as the adhesive.

We claim:

1. Process for the treatment of cellulose fibres with fixing agents before the manufacture of yarn, characterised in that cellulose fibres or their mixtures with synthetic fibres, in the form of a doubled pre-drawn sliver, are impregnated with fixing agents of the general formula

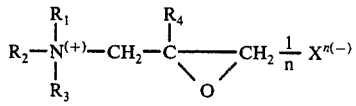

in which $R_1$, $R_2$, and $R_3$ represent a $C_1$-$C_4$-alkyl group, or a hydroxyl-substituted $C_2$-$C_4$-alkyl group or $R_1$ and $R_2$ can be joined to form a ring with N, $R_4$ represents hydrogen or a methyl group, $X^{n(-)}$ represents an anion and $n$ represents 1, 2 or 3, and with an adhesive selected from the group consisting of polyacrylates, copolymers thereof, polymethacrylates, copolymers thereof, polyvinylacetates, and alginates, and the impregnated fibres are subsequently fixed.

2. Process according to claim 1, characterised in that the sliver is dyed simultaneously with impregnation.

3. Process according to claim 1, characterised in that after impregnation the sliver is processed to give a yarn or textile sheet-like structure and is subsequently dyed.

4. Process according to claim 1, characterised in that the impregnation is carried out with fixing agents in which $R_1$ and $R_2$ are joined to form a ring with N.

5. Process according to claim 1, characterised in that the impregnation is carried out with adhesives which are free from hydroxyl groups.

* * * * *